US008203401B2

(12) United States Patent
Nakamura

(10) Patent No.: US 8,203,401 B2
(45) Date of Patent: Jun. 19, 2012

(54) STRIP LINE FILTER

(75) Inventor: Soichi Nakamura, Omihachiman (JP)

(73) Assignee: Murata Manufacturing Co., Ltd., Nagaokakyo-Shi, Kyoto-fu (JP)

( * ) Notice: Subject to any disclaimer, the term of this patent is extended or adjusted under 35 U.S.C. 154(b) by 407 days.

(21) Appl. No.: 12/578,054

(22) Filed: Oct. 13, 2009

(65) Prior Publication Data

US 2010/0090783 A1 Apr. 15, 2010

(30) Foreign Application Priority Data

Oct. 15, 2008 (JP) ..... 2008-265943

(51) Int. Cl.
*H01P 1/203* (2006.01)

(52) U.S. Cl. ..... 333/204; 333/203

(58) Field of Classification Search ..... 333/185, 333/203–205

See application file for complete search history.

(56) References Cited

U.S. PATENT DOCUMENTS

| | | | | |
|---|---|---|---|---|
| 5,506,553 | A * | 4/1996 | Makita et al. | 333/204 |
| 5,519,366 | A * | 5/1996 | Kaneko et al. | 333/204 |
| 5,719,539 | A | 2/1998 | Ishizaki et al. | |
| 6,020,799 | A | 2/2000 | Ishizaki et al. | |
| 6,304,156 | B1 | 10/2001 | Ishizaki et al. | |
| 6,323,745 | B1 * | 11/2001 | Toncich | 333/204 |
| 6,989,726 | B2 * | 1/2006 | Amano | 333/204 |
| 7,688,162 | B2 * | 3/2010 | Soora | 333/204 |
| 7,902,944 | B2 * | 3/2011 | Fukunaga | 333/203 |
| 2008/0224800 | A1 * | 9/2008 | Takei et al. | 333/204 |

FOREIGN PATENT DOCUMENTS

| | | |
|---|---|---|
| JP | 7-312503 | 11/1995 |
| JP | 3018214 | 3/2000 |

* cited by examiner

*Primary Examiner* — Seungsook Ham
(74) *Attorney, Agent, or Firm* — Dickstein Shapiro LLP

(57) ABSTRACT

A strip line filter includes a substantially rectangular plate-like shaped dielectric substrate. A ground electrode is arranged on a bottom surface of the substrate. A first resonant line and a second resonant line face the ground electrode through the substrate. Input/output electrodes are connected to the corresponding resonant lines. The first resonant line includes a first top-surface line, a connection line, and a second top-surface line. The first top-surface line is arranged on the top surface of the substrate and extends so as to pass a portion adjacent to a portion, on the left side, of a third top-surface line. The connection line and the second top-surface line are branched from the first top-surface line and pass a portion adjacent to a portion, on the right side, of the third top-surface line.

9 Claims, 6 Drawing Sheets

STRIP LINE FILTER

BACKGROUND OF THE INVENTION

1. Field of the Invention

The present invention relates to a strip line filter including a dielectric substrate and strip lines arranged on the dielectric substrate.

2. Description of the Related Art

Strip line filters including strip-line resonators arranged on dielectric substrates have been used in various fields (refer to Japanese Unexamined Patent Application Publication No. 7-312503).

Here, an example of an equivalent circuit of a conventional strip line filter will be described. FIG. 1 is a diagram illustrating an equivalent circuit of a conventional microstrip line filter 101 shown with reference to Japanese Unexamined Patent Application Publication No. 7-312503.

The microstrip line filter 101 is configured such that ¼ wavelength strip line resonators in two stages are coupled with each other in a comb-line manner and the ¼ wavelength strip line resonators are externally coupled with respective input/output terminals through external coupling capacitances $C_{01}$. Each of the ¼ wavelength strip line resonators has a stepped impedance configuration in which lines having different widths are arranged on an open-end side and a short-circuit side, and mutual capacitance on the open-end side and mutual capacitance on the short-circuit side are changed by controlling the line width on the open-end side and the line width on the short-circuit side to thereby control coupling between the resonators.

In order to realize wide-band filter characteristics in the conventional strip line filter, the line widths on the open-end sides should be made smaller so that the coupling between the resonators is enhanced. However, accuracy of shapes of electrodes is limited, and when the line widths are made smaller, variation of the characteristics due to size variation increases. Accordingly, a possible setting value of mutual capacitance has an upper limit and enhancement of the coupling between the resonators also has limit.

SUMMARY OF THE INVENTION

Accordingly, it is an object of the present invention to provide a strip line filter capable of controlling coupling between resonators by increasing mutual capacitance while line widths are ensured.

According to preferred embodiments of the present invention, a strip line filter includes a dielectric substrate, a ground electrode, a plurality of resonant lines, and input/output electrodes. The dielectric substrate has a substantially rectangular plate-like shape. The ground electrode is arranged on a bottom surface of the substrate. The resonant lines face the ground electrode through the dielectric substrate and form resonators. The input/output electrodes are connected to the corresponding resonant lines. A first resonant line among the plurality of resonant lines includes a main line section and a branch section. The main line section is arranged on a top surface of the dielectric substrate and arranged adjacent to a second resonant line on a first side of the second resonant line. The branch section is branched from the main line section and arranged adjacent to the second resonant line on a second side of the second resonant line.

With this configuration, capacitance generated between the branch section of the first resonant line and the second resonant line can be added to mutual capacitance generated between the first and second resonant lines. By this, the mutual capacitance increases without narrowing gaps between the line, and coupling between the resonators can be controlled.

The strip line filter may include an insulating layer which has a relative permittivity smaller than that of the dielectric substrate and which is laminated on the top surface of the dielectric substrate. In this case, the branch section may include a sub-line section and a connection section. The sub-line section is arranged on the top surface of the dielectric substrate and arranged adjacent to the second resonant line on a side opposite to the main line section. The connection section is arranged on the insulating layer so as to be separated from the dielectric substrate and is connected to the main line section and the sub-line section.

With this configuration, improved mechanical protection and improved environmental resistance of resonators are realized by the insulating layer. Furthermore, since the connection section is arranged on the insulating layer having a small relative permittivity, influence of the connection section to coupling can be prevented. In addition, a degree of freedom of arrangement of the sub-line section can be enhanced.

The sub-line section and the main line section may be arranged adjacent to an open end of the second resonant line such that directions of open ends of the sub-line section and the main line section are the same as a direction of the open end of the second resonant line.

With this configuration, a comb-line coupling filter having a type of stepped impedance configuration can be realized, and filter characteristics attaining a wide band and having an attenuation pole can be realized.

The connection section may face the second resonant line through the insulating layer at a portion of the connection section extending orthogonal to the second resonant line.

With this configuration, a minimum facing area between the connection section and the second resonant line is realized and the influence of the connection section to the coupling can be minimized.

External coupling between the main line section and a corresponding one of the input/output electrodes may be realized.

With this configuration, the attenuation pole can be formed on a low pass band side in a case of comb-line coupling, and an attenuation amount larger than that obtained in a case where the sub-line section is connected to a corresponding one of the input/output electrodes can be obtained.

According to the preferred embodiments of the present invention, since capacitance generated between the branch section and the second resonant line can be added to mutual capacitance, coupling between the resonators can be controlled by increasing the mutual capacitance without narrowing gaps among the lines. Accordingly, wide band filter characteristics can be realized by enhancing the coupling between the resonators.

Other features, elements, characteristics and advantages of the present invention will become more apparent from the following detailed description of preferred embodiments of the present invention with reference to the attached drawings.

DESCRIPTION OF THE PREFERRED EMBODIMENTS

A strip line filter 1 according to a first embodiment will now be described.

Figure 1:
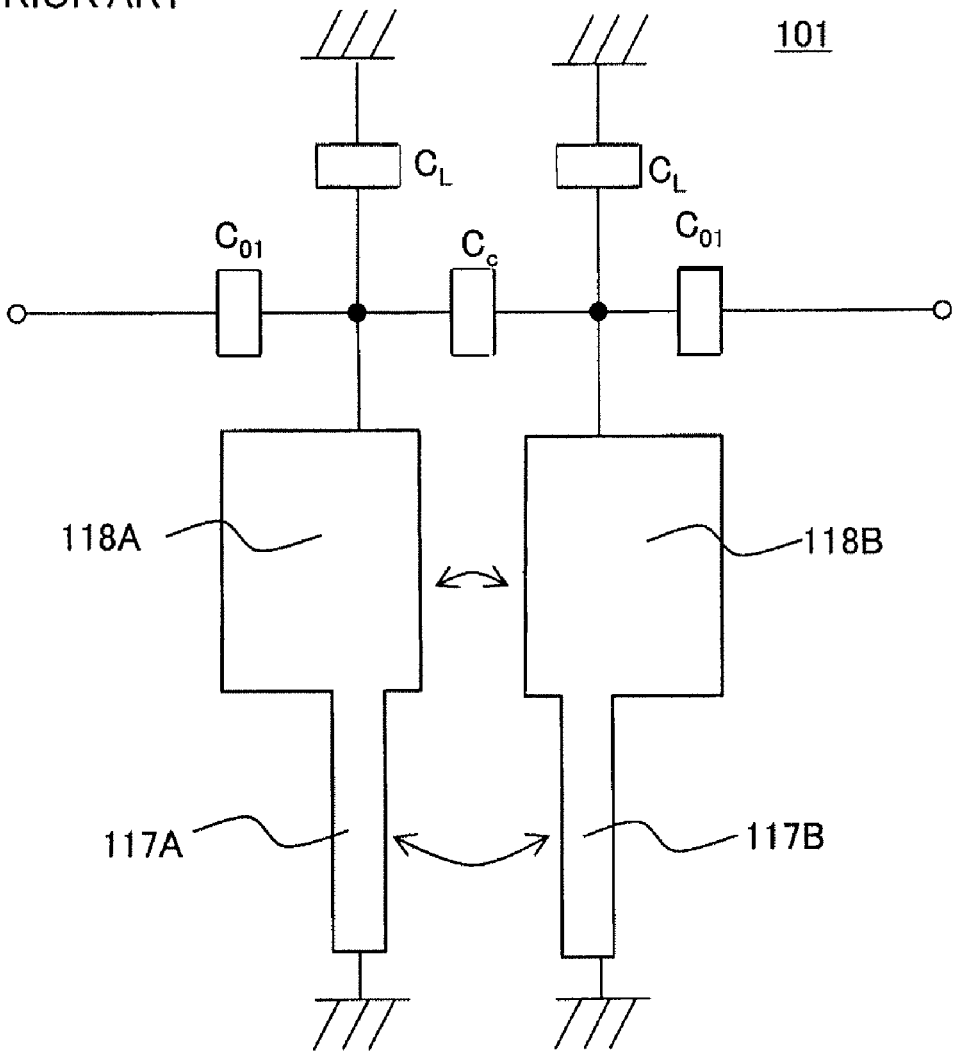
FIG. 1 PRIOR ART
FIG. 1 is a diagram illustrating an equivalent circuit of a conventional strip line filter.
Figure 2:
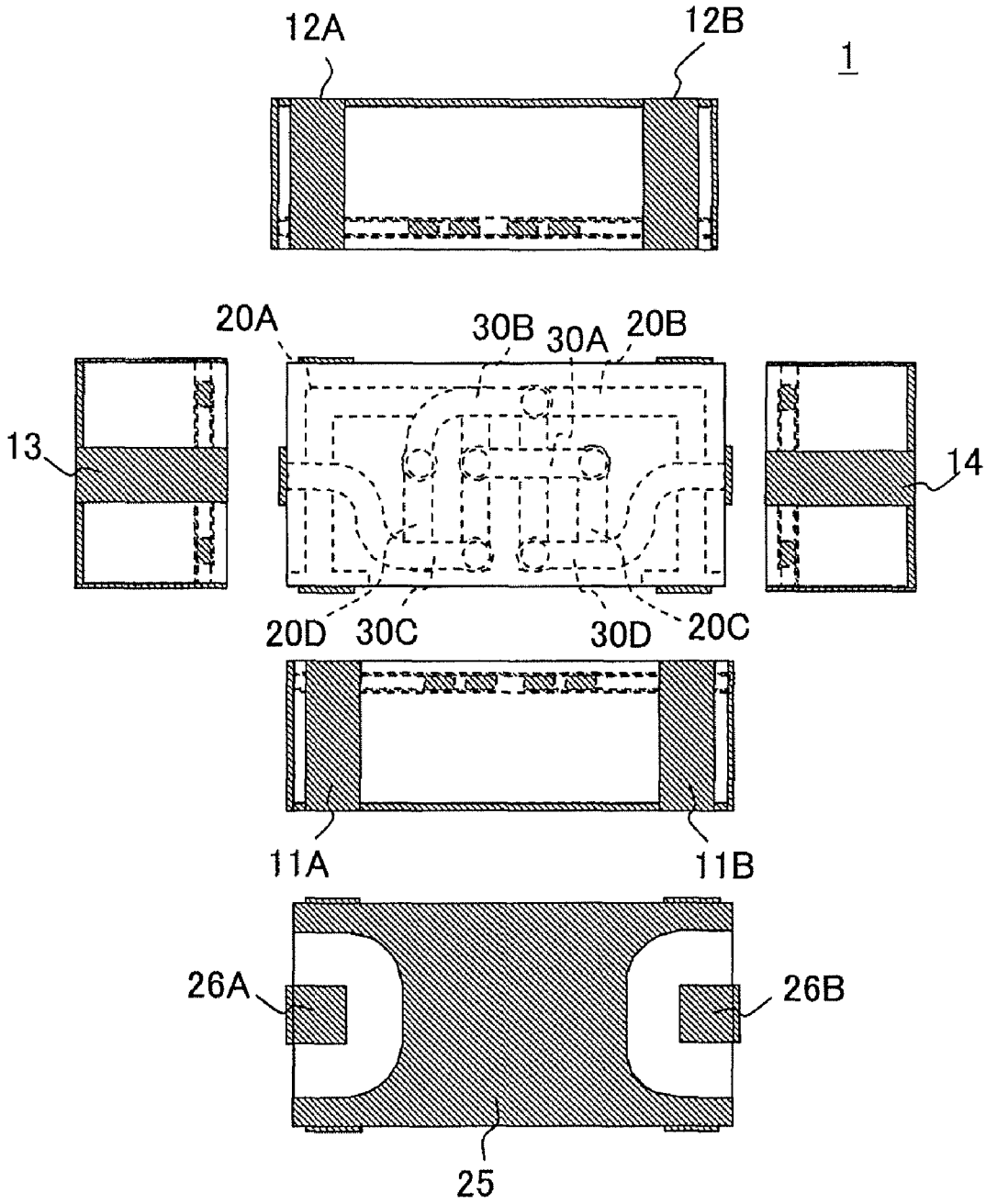
FIG. 2 is a development view illustrating a strip line filter according to a first embodiment.

The strip line filter 1 of this embodiment is a band pass filter for high bands of UWB (Ultra Wide Band) communication. FIG. 2 is a development view illustrating the strip line filter 1 of this embodiment.

The strip line filter 1 includes side-surface lines 11A and 11B on a front surface thereof. On a back surface of the strip line filter 1, side-surface lines 12A and 12B are arranged. On a left surface, a side-surface line 13 is arranged. On a right surface, a side-surface line 14 is arranged. On a bottom surface serving as an implementing surface, a ground electrode 25 and input/output electrodes 26A and 26B are arranged. The ground electrode 25 and the input/output electrodes 26A and 26B are arranged separately from each other. When the strip line filter 1 is implemented on an implementing substrate, high-frequency-signal input/output terminals are connected to the input/output electrodes 26A and 26B, and a ground electrode of the implementing substrate is connected to the ground electrode 25 serving as a ground surface of resonators. Each of the ground electrode 25, the input/output electrodes 26A and 26B, and the side-surface lines 11A, 11B, 12A, 12B, 13, and 14 is formed of a silver electrode having a thickness of approximately 12 μm, and formed by applying nonphotosensitive silver paste using screen masking or metal masking and performing sintering.

Figure 3:
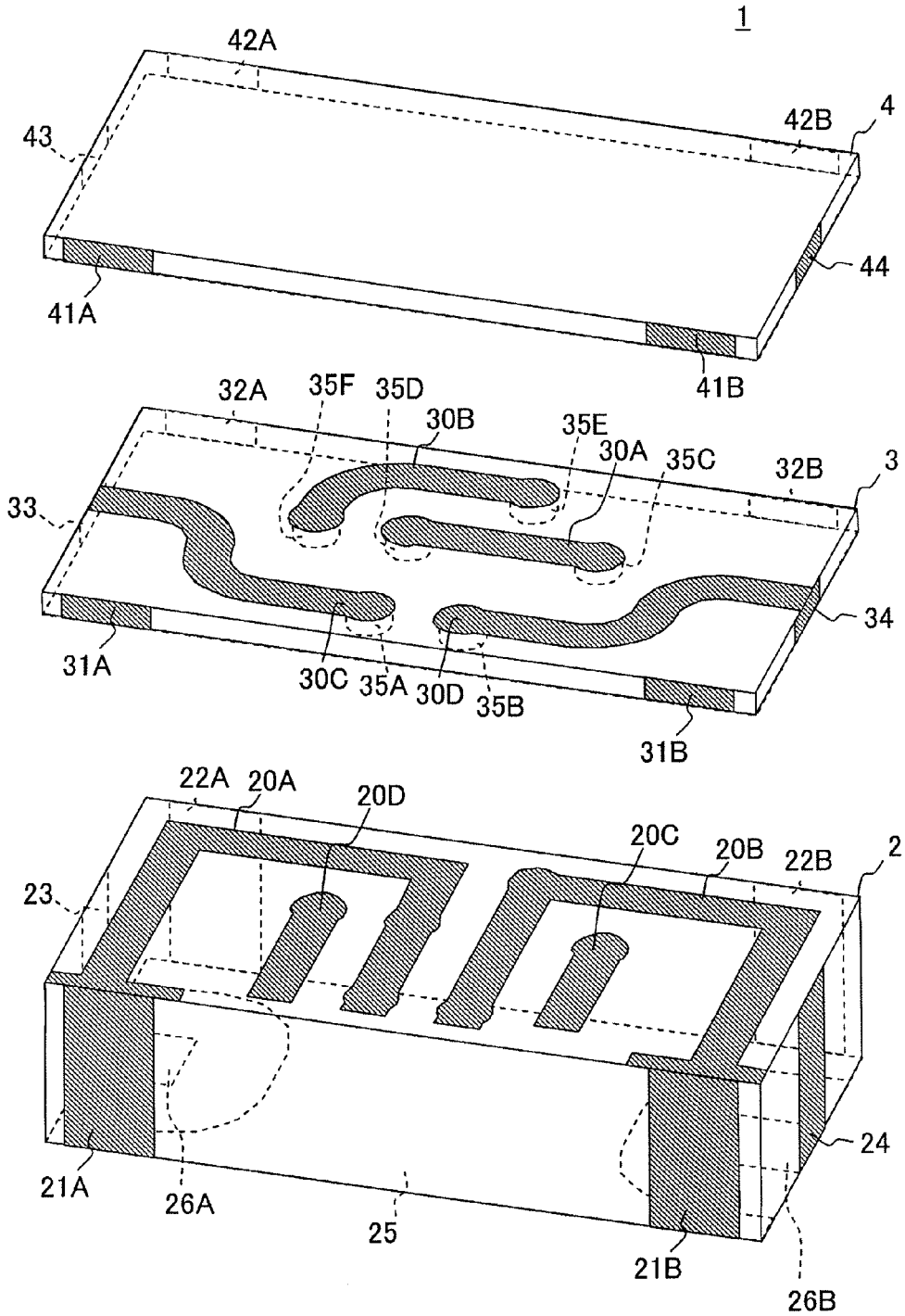
FIG. 3 is an exploded perspective view illustrating the strip line filter shown in FIG. 2.

FIG. 3 is an exploded perspective view illustrating the strip line filter 1.

The strip line filter 1 includes a dielectric substrate 2, and first and second glass layers 3 and 4 which are laminated in this order from the bottom surface.

The dielectric substrate 2 is a sintered ceramic substrate which has a substantially rectangular plate-like shape, which has a relative permittivity of approximately 111, and which is formed of titanium oxide, for example. The dielectric substrate 2 includes, on a top surface, top-surface lines 20A to 20D included in resonators in two stages. Each of the top-surface lines 20A to 20D is a silver electrode having a thickness of approximately 4 μm, and formed by applying photosensitive silver paste on the dielectric substrate 2 and performing patterning by a photolithography process and performing sintering. Since the photosensitive silver electrodes are employed, the strip line filter 1 which has the electrodes formed with high accuracy and which is usable in the UWB communication is obtained. Furthermore, since the thicknesses of the electrodes on the side surfaces and the bottom surface are larger than those of the electrodes of the top-surface lines 20A to 20D, current generated at portions of the resonators near a ground terminal where current constriction is generally generated is dispersed, and conductor loss is reduced.

On a bottom surface of the dielectric substrate 2, the ground electrode 25 and the input/output electrodes 26A and 26B are arranged. On a front surface of the dielectric substrate 2, side-surface lines 21A and 21B included in the side-surface lines 11A and 11B, respectively, are arranged. The side-surface lines 21A and 21B are connected to the top-surface lines 20A and 20B, respectively, at terminal portions near the top surface, and connected to the ground electrode 25 at terminal portions near the bottom surface. On a back surface, side-surface lines 22A and 22B included in the side-surface lines 12A and 12B, respectively, are arranged. The side-surface lines 22A and 22B are connected to the ground electrode 25 at terminal portions near the bottom surface. On a left surface, a side-surface line 23 included in the side-surface line 13 is arranged. The side-surface line 23 is connected to the input/output electrode 26A at a terminal portion near the bottom surface. On a right surface, a side-surface line 24 included in the side-surface line 14 is arranged. The side-surface line 24 is connected to the input/output electrode 26B at a terminal portion near the bottom surface.

The first glass layer 3 has a thickness of approximately 20 μm, and is laminated on the top surface of the dielectric substrate 2. On a top surface of the first glass layer 3, external connection lines 30C to 30D and connection lines 30A and 30B are arranged. On a front surface, side-surface lines 31A and 31B included in the side-surface lines 11A and 11B, respectively, are arranged. On a back surface, side-surface lines 32A and 32B included in the side-surface lines 12A and 12B, respectively, are arranged. On a left surface, a side-surface line 33 included in the side-surface line 13 is arranged. The side-surface line 33 is connected to the external connection line 30C at a terminal portion thereof near the top surface. On a right surface, a side-surface line 34 included in the side-surface line 14 is arranged. The side-surface line 34 is connected to the external connection line 30D at a terminal portion thereof near the top surface.

The second glass layer 4 of a thickness of approximately 20 μm has a light-shielding characteristic and is laminated on the top surface of the first glass layer 3. On a front surface of the second glass layer 4, side-surface lines 41A and 41B included in the side-surface lines 11A and 11B, respectively, are arranged. On a back surface, side-surface lines 42A and 42B included in the side-surface lines 12A and 12B, respectively, are arranged. On a left surface, a side-surface line 43 included in the side-surface line 13 is arranged. On a right side, a side-surface line 44 included in the side-surface line 14 is arranged.

The top-surface line 20A arranged on the top surface of the dielectric substrate 2 extends from a connection portion between the top-surface line 20A and the side-surface line 21A along the left surface and the back surface, and bends toward the front surface of the dielectric substrate 2 near the center of the dielectric substrate 2 so as to be formed in a substantially U-shape. The top-surface line 20B extends from a connection portion between the top-surface line 20B and the side-surface line 21B along the left surface and the back surface, and bends toward the front surface of the dielectric substrate 2 near the center of the dielectric substrate 2 so as to be formed in a substantially U-shape. The top-surface lines 20C and 20D are located near the center of the dielectric substrate 2 and extend from portions near the back surface of the dielectric substrate 2 toward the front surface of the dielectric substrate 2 so as to be formed in I-shapes.

The connection line 30A arranged on the top surface of the first glass layer 3 extends in a linear fashion, and one terminal portion of the connection line 30A near the left surface faces a portion of the top-surface line 20A which is far from a terminal portion of the top-surface line 20A near the center of the dielectric substrate 2 toward the back surface of the dielectric substrate 2, and the other terminal portion of the connection line 30A near the right surface faces one terminal portion of the top-surface line 20C near the back surface of the dielectric substrate 2. The connection line 30A is connected to the top-surface lines 20A and 20C through via holes 35C and 35D formed in the first glass layer 3.

The connection line 30B extends in a curved form, and one terminal portion of the connection line 30B near the right surface faces a portion of the top-surface line 20B which is far from one terminal of the top-surface line 20B near the center of the dielectric substrate 2 toward the back surface of the dielectric substrate 2 and the other terminal portion of the connection line 30B near the left surface faces one terminal portion of the top-surface line 20D near the back surface. The connection line 30B is connected to the top-surface lines 20B and 20D through via holes 35E and 35F formed in the first glass layer 3.

The connection line 30C extends from a connection portion between the connection line 30C and the side-surface line 33 to a portion facing an open end of the top-surface line 20A, and is connected to the top-surface line 20A through a via hole 35A formed in the first glass layer 3.

The connection line 30D extends from a connection portion between the connection line 30D and the side-surface line 34 to a portion facing an open end of the top-surface line 20B, and is connected to the top-surface line 20B through a via hole 35B formed in the first glass layer 3.

Therefore, the top-surface lines 20A and 20C are connected to each other through the connection line 30A arranged on the top surface of the first glass layer 3 and constitute a ¼ wavelength resonant line together with the side-surface line 21A. Furthermore, the top-surface lines 20B and 20D are connected to each other through the connection line 30B arranged on the top surface of the first glass layer 3 and constitute a ¼ wavelength resonant line together with the side-surface line 21B. External coupling between the resonant line including the top-surface lines 20A and 20C and the input/output electrode 26A is realized by tap connection through the connection line 30C, and external coupling between the resonant line including the top-surface lines 20B and 20D and the input/output electrode 26B is realized by tap connection through the connection line 30D.

With this configuration, the terminal portion of the top-surface line 20D near the front surface of the dielectric substrate 2, the terminal portion of the top-surface line 20A near the center of the dielectric substrate 2, the terminal portion of the top-surface line 20B near the center of the dielectric substrate 2, and the terminal portion of the top-surface line 20C near the front surface of the dielectric substrate 2 are directed toward the front surface of the dielectric substrate 2. Therefore, the resonator lines are coupled with each other in a comb-line manner and filter characteristics having an attenuation pole can be realized in the strip line filter 1.

Moreover, the terminal portion of the top-surface line 20D near the front surface of the dielectric substrate 2, the terminal portion of the top-surface line 20A near the center of the dielectric substrate 2, the terminal portion of the top-surface line 20B near the center of the dielectric substrate 2, and the terminal portion of the top-surface line 20C near the front surface of the dielectric substrate 2 are arranged in this order from the left-surface side to the right-surface side. Therefore, the top-surface line 20A is arranged between the top-surface lines 20B and 20D which are included in the single resonant line, and the top-surface line 20B is arranged between the top-surface lines 20A and 20C included in the other single resonant line. That is, the top-surface line 20A corresponds to a main line section according to this embodiment of the present invention, the connection line 30A and the top-surface line 20C correspond to a branch section according to this embodiment of the present invention, the connection line 30A corresponds to a connection section according to this embodiment of the present invention, and the top-surface line 20C corresponds to a sub-line section according to this embodiment of the present invention. Moreover, the top-surface line 20B corresponds to a main line section according to this embodiment of the present invention, the connection line 30B and the top-surface line 20D correspond to a branch section according to this embodiment of the present invention, the connection line 30B corresponds to a connection section according to this embodiment of the present invention, and the top-surface line 20D corresponds to a sub-line section according to this embodiment of the present invention. Accordingly, the strip line filter 1 functions as the two resonant lines having stepped impedance configurations which are coupled with each other in a comb-line manner, and attains large mutual capacitance since mutual capacitance is ensured in at the open ends of both the main line sections (top-surface lines 20A and 20B). Accordingly, a resonant frequency in an odd mode becomes lower than a resonant frequency in an even mode, capacitance coupling between the resonant lines are enhanced, and wide-band filter characteristics of the strip line filter 1 is attained.

Note that since the first and second glass layers 3 and 4 are laminated on the dielectric substrate 2, mechanical protection and environmental resistance of an electrode pattern on the top surface of the dielectric substrate 2 and an electrode pattern on the top surface of the first glass layer 3 are ensured. The first glass layer 3 and the second glass layer 4 have relative permittivity smaller than that of the dielectric substrate 2 and constitute an insulating layer according to this embodiment of the present invention. Therefore, although the connection lines 30A and 30B face the top-surface lines 20A to 20D, generated capacitance is negligible and the mutual capacitance near the open ends are easily set by merely controlling gaps among the top-surface lines 20A to 20D.

Here, the strip line filter 1 having the configuration described above is compared with a strip line filter 102 serving as a comparative example which does not include the top-surface lines 20C and 20D and the connection lines 30A and 30B.

Figure 4A:
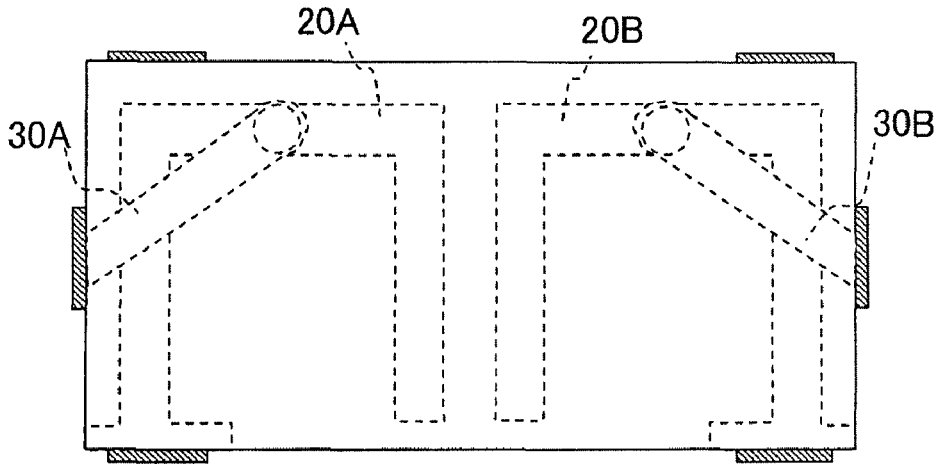
FIG. 4A PRIOR ART
FIGS. 4A and 4B are diagrams used to compare filter characteristics of a configuration of the first embodiment with filter characteristics of a conventional configuration.

FIG. 4A is a top plan view illustrating the strip line filter 102 of the comparative example. In this configuration, a connection portion of an external connection line in the strip line filter 102 is adjusted so that return loss of filter characteristics which is substantially the same as that of the strip line filter 1 is attained.

As results of calculations of coupling coefficients between the resonant lines, it is recognized that the coupling coefficient between the resonant lines of the strip line filter 1 is approximately 52.4%, and the coupling coefficient between resonant lines of the strip line filter 102 is approximately 23.7%, and accordingly, the coupling coefficient between the resonant lines of the strip line filter 1 is twice or more the coupling coefficient between the resonant lines of the strip line filter 102.

Figure 4B:
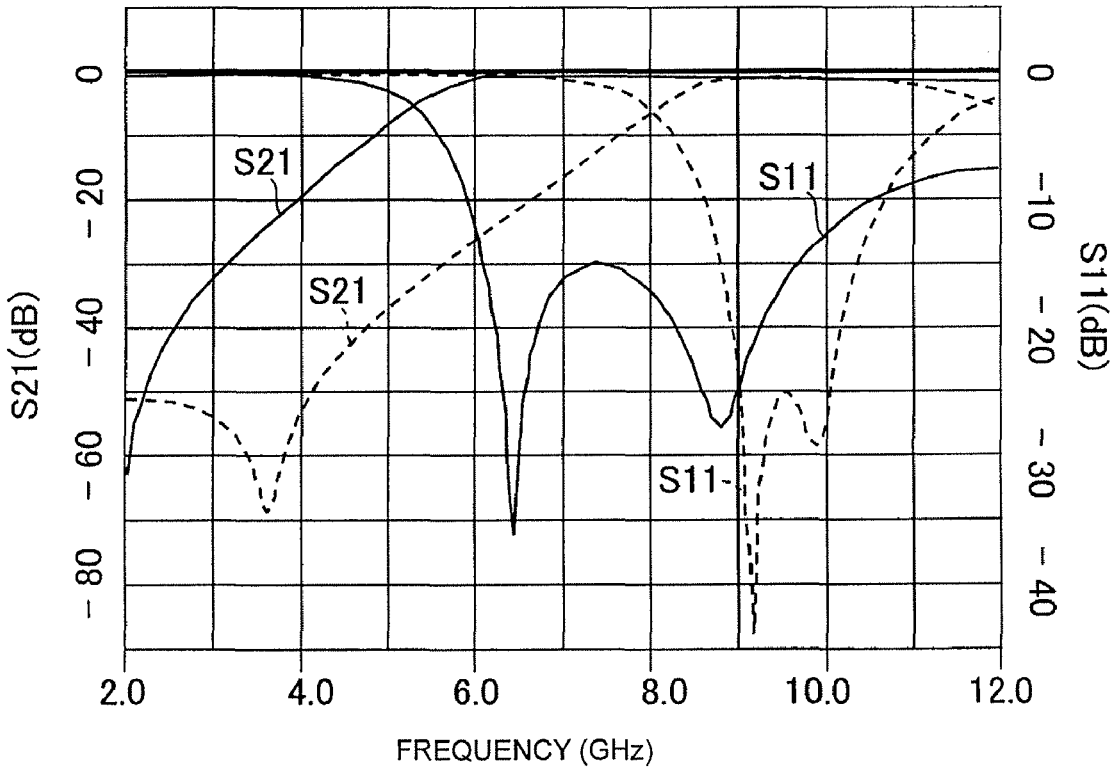

Accordingly, wider band filter characteristics can be realized in this embodiment when compared with the comparative example. FIG. 4B is a graph illustrating results of simulations of the filter characteristics of the strip line filter 102 and the filter characteristics of the strip line filter 1.

As results of the simulations, it is realized that a pass band of the strip line filter 1 is approximately 6 GHz to approximately 10.5 GHz, a pass band of the strip line filter 102 is approximately 8.7 GHz to approximately 10.5 GHz, and accordingly, wider band filter characteristics are realized in this embodiment when compared with the comparative example.

Note that the side-surface lines 12A and 12B are not required in terms of an electric configuration. Therefore, the side-surface lines 12A and 12B are arranged so as to be separated from the top-surface lines 20A to 20D so as not to affect the filter characteristics. However, in this embodiment, an electrode pattern including the side-surface lines 12A and 12B on the back surface is formed so as to correspond to an electrode pattern including the side-surface lines 11A and 11B on the front surface in a point symmetric manner so that a manufacturing process is facilitated. Specifically, patterning of electrodes on the front surface and the back surface are performed without distinguishing between the front surface and the back surface and between the top surface and the bottom surface using the same one of metal masking and screen masking. Similarly, an electrode pattern including the side-surface line 13 and an electrode pattern including the side-surface line 14 are formed so as to be the same as each other and symmetrically arranged relative to a point. Accordingly, manufacturing processing is facilitated.

Note that, in this embodiment, while a facing area in which the connection line 30A and the top-surface line 20B face each other is made minimum, line lengths of the top-surface lines 20A and 20C are balanced but line lengths of the top-surface lines 20B and 20D are not balanced. However, it is possible that balanced line lengths attain desired filter characteristics rather than the minimum facing area. In such a case, the line lengths of the resonant lines are balanced.

Next, a strip line filter 50 according to a second embodiment of the present invention will be described.

Figure 5:
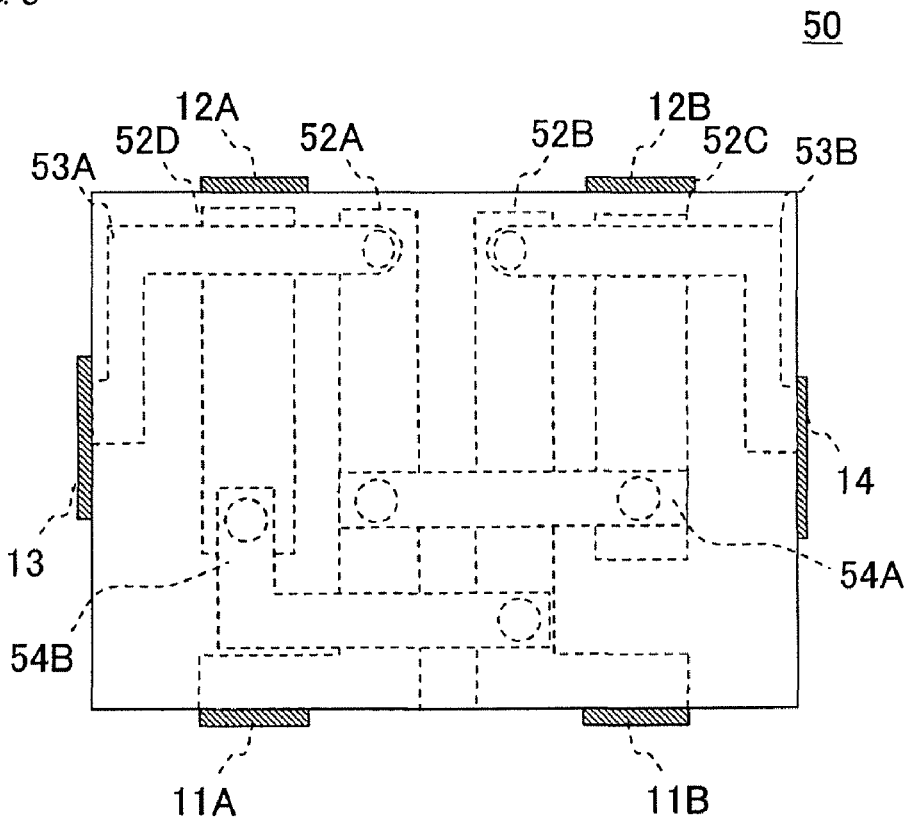
FIG. 5 is a top plan view illustrating a strip line filter according to a second embodiment.

FIG. 5 is a top plan view illustrating the strip line filter 50 of this embodiment. In the strip line filter 50, electrode patterns of a top surface of a substrate 2 and a top surface of a first glass layer 3 are different from those of first embodiment. Note that components the same as those shown in the first embodiment are denoted by reference numerals the same as those used in the first embodiment, and therefore, descriptions thereof are omitted.

On the top surface of the dielectric substrate 2, top-surface lines 52A to 52D included in resonators in two stages are arranged. The top-surface line 52A extends from a connection portion between the top-surface line 52A and a side-surface line 11A toward the center of a front surface of the dielectric substrate 2, and bends at a portion near the center of the front surface of the substrate 2 toward a back surface of the dielectric substrate 2 so as to form an L-shape. The top-surface line 52B extends from a connection portion between the top-surface line 52B and a side-surface line 11B toward the center of the front surface of the dielectric substrate 2, and bends at a portion near the center of the front surface of the substrate 2 toward the back surface of the dielectric substrate 2 so as to form an L-shape. The top-surface line 52C is arranged near a right surface of the dielectric substrate 2 relative to the top-surface line 52B and extends from a portion near the front surface of the dielectric substrate 2 toward the back surface of the dielectric substrate 2 so as to form an I-shape. The top-surface line 52D is arranged near a left surface of the dielectric substrate 2 relative to the top-surface line 52A and extends from a portion near the front surface of the dielectric substrate 2 toward the back surface of the dielectric substrate 2 so as to form an I-shape.

On a top surface of the first glass layer 3, an external connection lines 53A and 53B and connection lines 54A and 54B are arranged. The connection line 54A is formed as a straight line, and has one terminal portion which is located near the left surface and which faces a portion of the top-surface line 52A near the center of the dielectric substrate 2 and the other terminal portion which is located near the right surface and which faces a portion of the top-surface line 52C near the front surface of the dielectric substrate 2. The connection line 54A is connected to the top-surface lines 52A and 52C through via holes formed in the first glass layer 3. The connection line 54B bends at a certain portion. The connection line 54B has one terminal portion which is located near the right surface and which faces a portion of the top-surface line 52B near the center of the front surface of the dielectric substrate 2, and the other terminal portion which is located near the left surface and which faces one terminal portion of the top-surface line 52D which is located near the front surface of the dielectric substrate 2. The connection line 54B is connected to the top-surface lines 52B and 52D through via holes formed in the first glass layer 3.

The external connection line 53A extends from a connection portion between the external connection line 53A and the side-surface line 13 to a portion facing an open end of the top-surface line 52A, and is connected to the top-surface line 52A through a via hole formed in the first glass layer 3. The external connection line 53B extends from a connection portion between the external connection line 53B and the side-surface line 14 to a portion facing an open end of the top-surface line 52B, and is connected to the top-surface line 52B through a via hole formed in the first glass layer 3.

Accordingly, the top-surface lines 52A and 52C are connected to each other through the connection line 54A and are included in a single ¼ wavelength resonant line. Furthermore, the top-surface lines 52B and 52D are connected to each other through the connection line 54B and are included in a single ¼ wavelength resonant line.

A portion of the top-surface lines 52A and a portion of the connection line 54B face each other through the first glass layer 3. Since a direction in which the top-surface line 52A extends and a direction in which the connection line 54B extends are orthogonal to each other, a minimum facing area is realized. Therefore, capacitance generated between the top-surface line 52A and the connection line 54B is negligible, and mutual capacitances of open ends can be easily set by merely controlling gaps among the top-surface lines 52A to 52D. This is true of the relationship between the top-surface line 52B and the connection line 54A.

Next, a strip line filter 60 according to a third embodiment of the present invention will be described.

Figure 6:
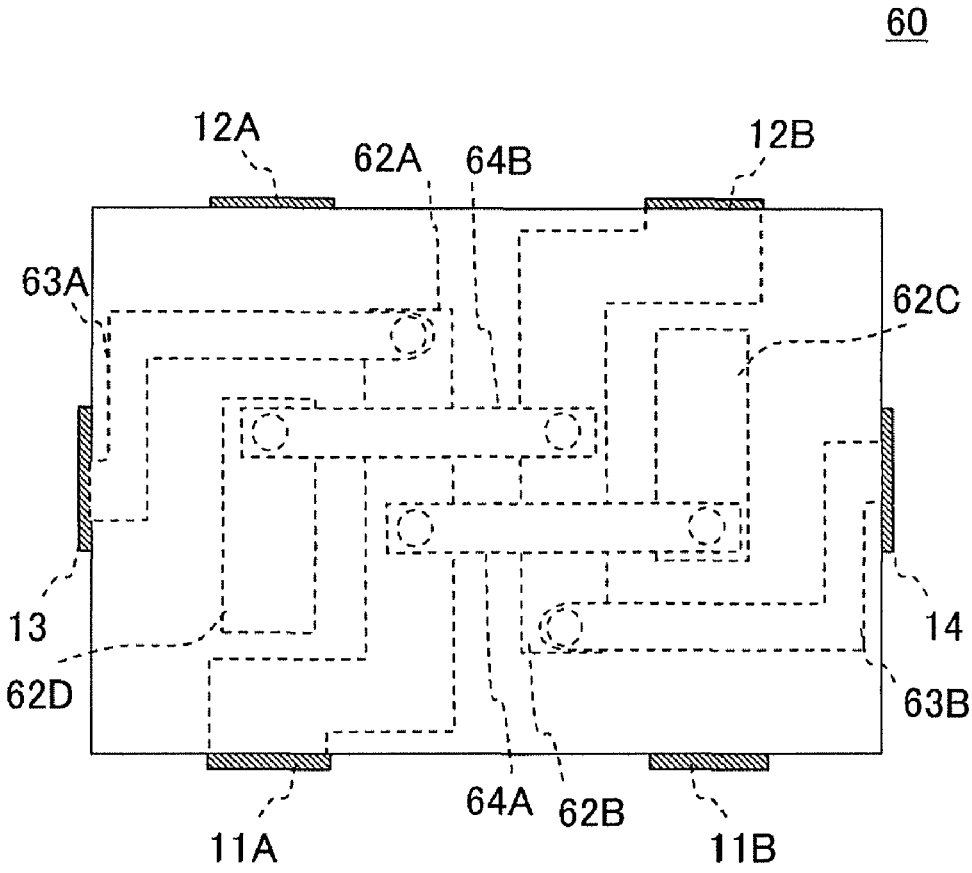
FIG. 6 is a top plan view illustrating a strip line filter according to a third embodiment.

FIG. 6 is a top plan view illustrating the strip line filter 60 of this embodiment. In the strip line filter 60, electrode patterns on a top surface of a dielectric substrate 2 and a top surface of a first glass layer 3 are different from the strip line filters of the first and second embodiments, and resonant lines are coupled with each other in an interdigital manner. Note that components the same as those shown in the first embodiment are denoted by reference numerals the same as those used in the first embodiment, and therefore, descriptions thereof are omitted.

On the top surface of the dielectric substrate 2, top-surface lines 62A to 62D included in resonators in two stages are arranged. The top-surface line 62A extends from a connection portion between the top-surface line 62A and a side-surface line 11A toward the center of a front surface of the dielectric substrate 2, and bends at a portion near the center of the front surface of the substrate 2 toward a back surface of the dielectric substrate 2 so as to form an L-shape. The top-surface line 62B extends from a connection portion between the top-surface line 62B and a side-surface line 12B toward the center of aback surface of the dielectric substrate 2, and bends at a portion near the center of the back surface of the substrate 2 toward the front surface of the dielectric substrate 2 so as to form an L-shape. The top-surface line 62C is arranged near a right surface of the dielectric substrate 2 relative to the top-surface line 62B and extends from a portion near the front surface of the dielectric substrate 2 toward the back surface of the dielectric substrate 2 so as to form an I-shape. The top-surface line 62D is arranged near a left surface of the dielectric substrate 2 relative to the top-surface line 62A and extends from a portion near the back surface of the dielectric substrate 2 toward the front surface of the dielectric substrate 2 so as to form an I-shape.

On a top surface of the first glass layer 3, an external connection lines 63A and 63B and connection lines 64A and 64B are arranged. The connection line 64A is formed as a straight line, and has one terminal portion which is located near the left surface and near the center of the dielectric substrate 2 and which faces a portion of the top-surface line 62A and the other terminal portion which is located near the right surface and near the front surface of the dielectric substrate 2 and which faces a portion of the top-surface line 62C. The connection line 64A is connected to the top-surface lines 62A and 62C through via holes formed in the first glass layer 3. The connection line 64B extends as a straight line. The connection line 64B has one terminal portion which is located near the right surface and near the center of the dielectric substrate 2 and which faces a portion of the top-surface line 62B, and the other terminal portion which is located near the left surface and which faces one terminal portion of the top-surface line 62D which is located near the back surface of the dielectric substrate 2. The connection line 64B is connected to the top-surface lines 62B and 62D through via holes formed in the first glass layer 3.

The external connection line 63A extends from a connection portion between the external connection line 63A and the side-surface line 13 to a portion facing an open end of the top-surface line 62A, and is connected to the top-surface line 62A through a via hole formed in the first glass layer 3. The external connection line 63B extends from a connection portion between the external connection line 63B and the side-surface line 14 to a portion facing an open end of the top-surface line 62B, and is connected to the top-surface line 62B through a via hole formed in the first glass layer 3.

Accordingly, the top-surface lines 62A and 62C are connected to each other through the connection line 64A and are included in a single ¼ wavelength resonant line. Furthermore, the top-surface lines 62B and 62D are connected to each other through the connection line 64B and are included in a single ¼ wavelength resonant line.

In this configuration, directions of the open end of the top-surface line 62A and an open end of the top-surface line 62C are different from directions of the open end of the top-surface line 62B and an open end of the top-surface line 62D and the resonant lines are coupled with each other in an interdigital manner. Accordingly, coupling between the resonators is stronger than that using comb-line coupling. Also in this case, mutual capacitance is increased while gaps between the lines are ensured so that the coupling between the resonators is controlled.

According to the configurations of the foregoing embodiments, although the branch sections extend through the insulating layer, the present invention is suitably applicable to a configuration in which the branch sections extend within the top surface of the dielectric substrate 2 and a configuration in which the branch sections extend in the dielectric substrate 2, for example.

The arrangement position and the shapes of the top-surface lines and the connection lines depend on specification of a product, and any arrangement position and any shape may be employed as long as they comply with the specification of the product. The embodiments of the present invention may also be applicable to configurations other than the configuration described above, and applicable to various pattern forms of various filters. Furthermore, the filters of the foregoing embodiment may further include another configuration (a high-frequency circuit).

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. A strip line filter comprising:

a dielectric substrate having a top surface and a bottom surface;

an insulating layer which has a relative permittivity smaller than that of the dielectric substrate on the top surface of the dielectric substrate a ground electrode arranged on the bottom surface of the dielectric substrate;

a plurality of resonant lines arranged on the top surface of the dielectric substrate so as to face the ground electrode through the dielectric substrate; and input/output electrodes connected to a corresponding resonant line of the plurality of resonant lines, wherein a first resonant line among the plurality of resonant lines includes a main line section arranged adjacent to a second resonant line on a first side of the second resonant line and a branch section which is branched from the main line section and which is arranged adjacent to the second resonant line on a second side of the second resonant line, and wherein the branch section is arranged on the top surface of the dielectric substrate and includes a sub-line section which is arranged adjacent to the second resonant line on the second side thereof and a connection section which is arranged on the insulating layer and is separate from the dielectric substrate and connected to the main line section and the sub-line section.

2. The strip line filter according to claim 1, wherein the sub-line section and the main line section are arranged adjacent to an open end of the second resonant line such that directions of open ends of the sub-line section and the main line section are the same as a direction of the open end of the second resonant line.

3. The strip line filter according to claim 1, wherein the connection section faces the second resonant line through the insulating layer at a portion of the connection section extending orthogonal to the second resonant line.

4. The strip line filter according to claim 1, wherein the main line section and a corresponding one of the input/output electrodes are externally coupled.

5. The strip line filter according to claim 1, wherein the first resonant line and the second resonant line are coupled in a comb-line manner.

6. The strip line filter according to claim 1, wherein the first resonant line and the second resonant line are coupled in an interdigital manner.

7. The strip line filter according to claim 1, wherein the main line section has a substantial U-shape.

8. The strip line filter according to claim 1, wherein the main line section has a substantial L-shape.

9. The strip line filter according to claim 1, wherein the insulating layer includes a first glass layer and a second glass layer.

* * * * *